US012643055B2

(12) United States Patent
Takeuchi

(10) Patent No.: US 12,643,055 B2
(45) Date of Patent: Jun. 2, 2026

(54) ARTWORK AND A METHOD FOR MANUFACTURING AN ARTWORK

(71) Applicant: Osamu Takeuchi, Toyama (JP)

(72) Inventor: Osamu Takeuchi, Toyama (JP)

( * ) Notice: Subject to any disclaimer, the term of this patent is extended or adjusted under 35 U.S.C. 154(b) by 253 days.

(21) Appl. No.: 18/035,324

(22) PCT Filed: Sep. 7, 2021

(86) PCT No.: PCT/JP2021/032814
§ 371 (c)(1),
(2) Date: May 4, 2023

(87) PCT Pub. No.: WO2022/219830
PCT Pub. Date: Oct. 20, 2022

(65) Prior Publication Data

US 2024/0001254 A1 Jan. 4, 2024

(30) Foreign Application Priority Data

Apr. 16, 2021 (JP) ..... 2021-069676

(51) Int. Cl.
*A63H 33/10* (2006.01)
*A63H 9/00* (2006.01)

(52) U.S. Cl.
CPC ..... *A63H 33/10* (2013.01); *A63H 9/00* (2013.01)

(58) Field of Classification Search
CPC ..... A63H 33/10; A63H 9/00
USPC ..... 428/542.2
See application file for complete search history.

(56) References Cited

FOREIGN PATENT DOCUMENTS

| | | | |
|---|---|---|---|
| CN | 102805510 A | * | 12/2012 |
| JP | 56-10800 | | 1/1981 |
| JP | 2017213791 A | * | 12/2017 |
| JP | 6847593 | | 3/2021 |

OTHER PUBLICATIONS

Shen, CN102805510 A Google Patents Machine translation printed Mar. 31, 2025, Dec. 5, 2012, entire translation (Year: 2012).*
Marsh Fasteners, "How to Choose Between Fully & Partially Threaded Bolts", Nov. 2, 2017, URL: <https://marshfasteners.com/how-to-choose-between-fully-partially-threaded-bolts/>, pp. 1-6 (Year: 2017).*
Takeuchi, JP2017213791 A Google Patents machine translation printed Jun. 11, 2025, Dec. 7, 2017, entire translation (Year: 2017).*
International Search Report issued in International Patent Application No. PCT/JP2021/032814, dated Oct. 12, 2021.

* cited by examiner

*Primary Examiner* — Katherine A Christy
(74) *Attorney, Agent, or Firm* — Greenblum & Bernstein, P.L.C.

(57) ABSTRACT

An artwork that enables various abstract expressions and can reduce transport costs. This artwork is constituted by a combination of a plurality of parts having various shapes. Each part includes a joint portion. The joint portion has a cylindrical body having a prescribed length and a continuous thread bolt attached to an outer peripheral surface of the cylindrical body. The continuous thread bolt is fixed into a hole formed in the part, with the outer peripheral surface of the cylindrical body attached in contact with or close to the part. The parts are joinable to and separable from each other by contacting the joint portions of the parts to each other at end surfaces of the cylindrical body and passing a shaft through the cylindrical bodies.

3 Claims, 12 Drawing Sheets

1a , 1 b , 1 c : parts
3 : joint portion
4 : bolt ( shaft )
5 : nut

ARTWORK AND A METHOD FOR MANUFACTURING AN ARTWORK

TECHNICAL FIELD

The present invention relates to an artwork and a method for manufacturing an artwork.

BACKGROUND ART

Conventionally, a representative example of metal artwork is a bronze statue. Bronze statues mostly depict portraits such as Buddha statues and nude female statues, and they lack novelty, making them unsuitable for the lifestyles and sensibilities of modern people. Additionally, because bronze statues are cast as a single unit, they cannot be compactly packaged for transport, resulting in enormous shipping costs when transporting them overseas.

SUMMARY OF INVENTION

Technical Problem

In view of the aforementioned circumstances, an object of the present invention is to provide an artwork and a manufacturing method thereof that allows for diverse abstract expressions while reducing transportation costs.

Solution to Problem

In order to achieve the object, the present claim 1 recites:

An artwork comprising a plurality of parts having various shapes, wherein each part is provided with joint portions, and the joint portion has a cylindrical body with a prescribed length and a fully threaded bolt attached to an outer peripheral surface of the cylindrical body, wherein the outer peripheral surface of the cylindrical body is fixed in contact with or close to the part, by the fully threaded bolt inserted into a hole formed in the part, and by screwing a nut onto the fully threaded bolt protruding from the hole, and wherein the cylindrical bodies of the joint portions of the parts are secured in a rotationally fixed manner, by contacting the joint portions of each part to each other at end surfaces of the cylindrical body, and by screwing a nut onto a bolt passing through the cylindrical bodies.

Also, the present claim 2 recites:

A method for manufacturing an artwork comprising the steps of:

applying surface treatment to a plurality of parts having various shapes;

processing attachment holes for joint portions on each surface-treated part;

fixing the outer peripheral surface of the cylindrical body in contact with or close to the part, by attaching a fully threaded bolt to an outer peripheral surface of the cylindrical body, and by fixing the fully threaded bolt into a hole formed in the part, and connecting the parts to each other and securing the cylindrical bodies of the joint portions of each part in a rotationally fixed manner, by contacting the joint portions of each part to each other at end surfaces of the cylindrical body, and by screwing a nut onto a bolt passing through the cylindrical bodies.

Advantageous Effects of Invention

The artwork according to claim 1 is capable of a diverse abstract expression by combining multiple parts of various shapes. In addition, since the parts can be joined and separated, they can be dismantled into individual parts for compact transportation, resulting in reduced transportation costs.

Furthermore, in the artwork of the present invention, each part has a joint portion, and the joint portion has a cylindrical body of a predetermined length and a full-threaded bolt attached to the outer peripheral surface of the cylindrical body. The full-threaded bolt is inserted into a hole formed in the part, and the nut is screwed onto the full-threaded bolt protruding from the hole to tighten and fix the outer peripheral surface of the cylindrical body to the part in contact or proximity. The joint portions of the respective parts are fixed to each other by inserting bolts through the cylindrical bodies and attaching nuts, thereby fixing the cylindrical bodies of the joint portions of the respective parts to prevent relative rotation. As a result, disassembly and assembly can be easily and quickly performed by anyone, and the use of cylindrical bodies in the joint portions ensures that there is no discomfort even if they are exposed externally, and the appearance is not compromised. Moreover, by not welding the cylindrical bodies of the joint portions to the parts, it is possible to provide joint portions at any position on the parts after surface treatment such as plating has been performed on the parts, thus improving the freedom of fabrication. Since the joint portions can be easily removed, reuse of the parts is also easy.

The method for manufacturing an artwork according to claim 2 comprising the steps of: applying surface treatment to a plurality of parts having various shapes; processing attachment holes for joint portions on each surface-treated part; fixing the outer peripheral surface of the cylindrical body in contact with or close to the part, by attaching a fully threaded bolt to an outer peripheral surface of the cylindrical body, and by fixing the fully threaded bolt into a hole formed in the part, and connecting the parts to each other and securing the cylindrical bodies of the joint portions of each part in a rotationally fixed manner, by contacting the joint portions of each part to each other at end surfaces of the cylindrical body, and by screwing a nut onto a bolt passing through the cylindrical bodies. Therefore, the method allows for diverse abstract expressions by combining variously shaped parts. Furthermore, since the parts can be joined and separated, when transporting, they can be disassembled into individual parts and made compact, reducing transportation costs. Moreover, by not welding the cylindrical bodies of the joint portions to the parts, joint portions can be provided at any position on the parts after surface treatment such as plating has been performed on the parts, thus improving the freedom of fabrication. Since the joint portions can be easily removed, reuse of the parts is also easy.

DESCRIPTION OF EMBODIMENTS

Figure 1:
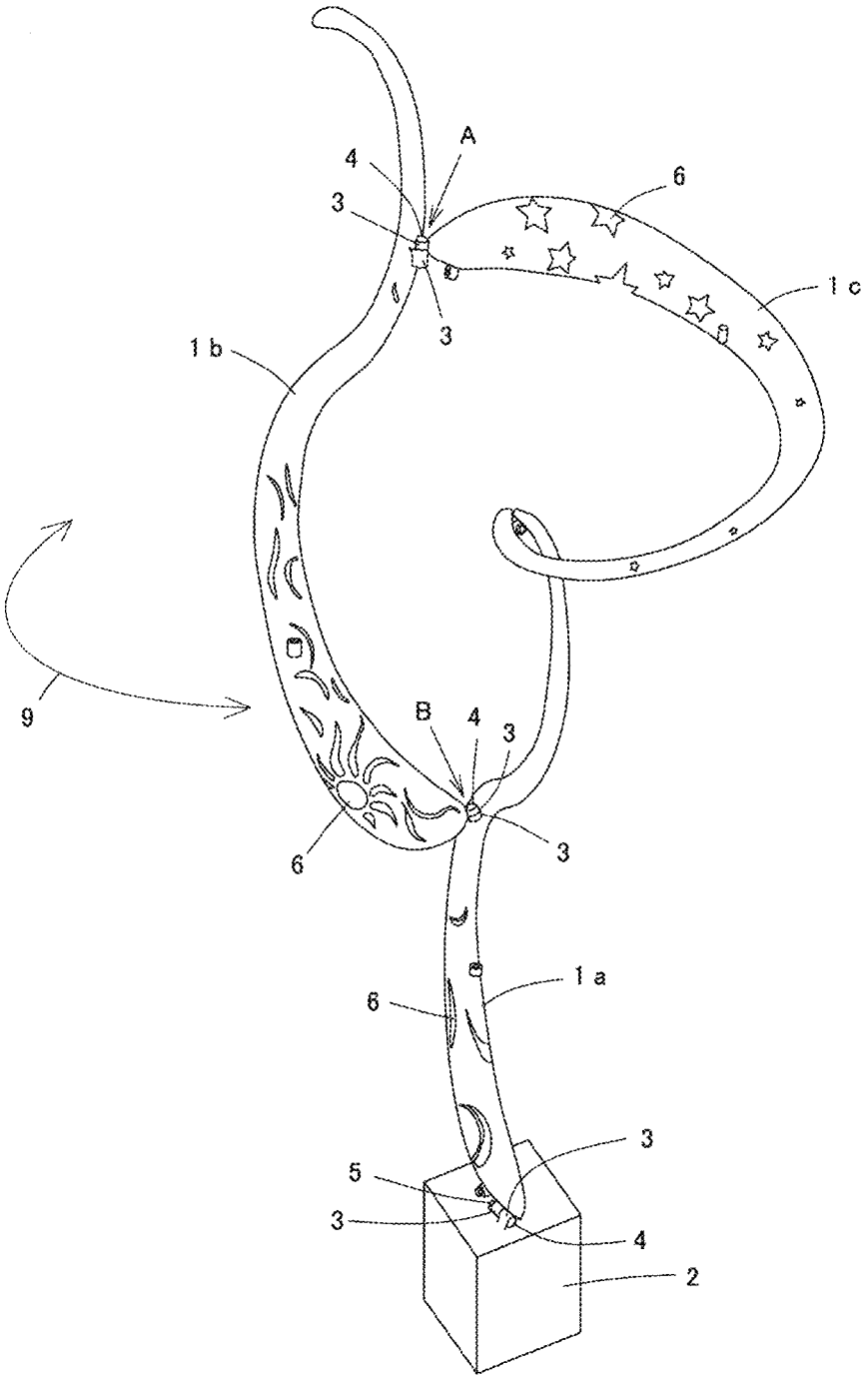
FIG. 1 is a perspective view showing one embodiment of the artwork according to the present invention.

The following is a description of embodiments of the present invention based on the drawings. FIG. 1 shows one embodiment of a artwork according to the present invention. This artwork is composed of two approximately S-shaped parts 1*a*, 1*b* and one approximately C-shaped part 1*c*, and includes a base 2 for standing and displaying the assembled three parts 1*a*, 1*b*, and 1*c*. By combining the approximately S-shaped parts 1*a*, 1*b* and the approximately C-shaped part 1*c* as appropriate, this artwork expresses the artist's various thoughts and concepts, creating a new genre of art. This artwork is approximately 1-2 meters tall.

Each of the parts 1*a*, 1*b*, and 1*c* is formed as a hollow metal casting with multiple holes 6 on the surface resembling stars, sun, etc. Opening multiple holes 6 in parts 1*a*, 1*b*, and 1*c* not only enhances the artistic quality but also reduces the weight. Each of the parts 1*a*, 1*b*, and 1*c* has a surface plating applied.

Figure 6A:
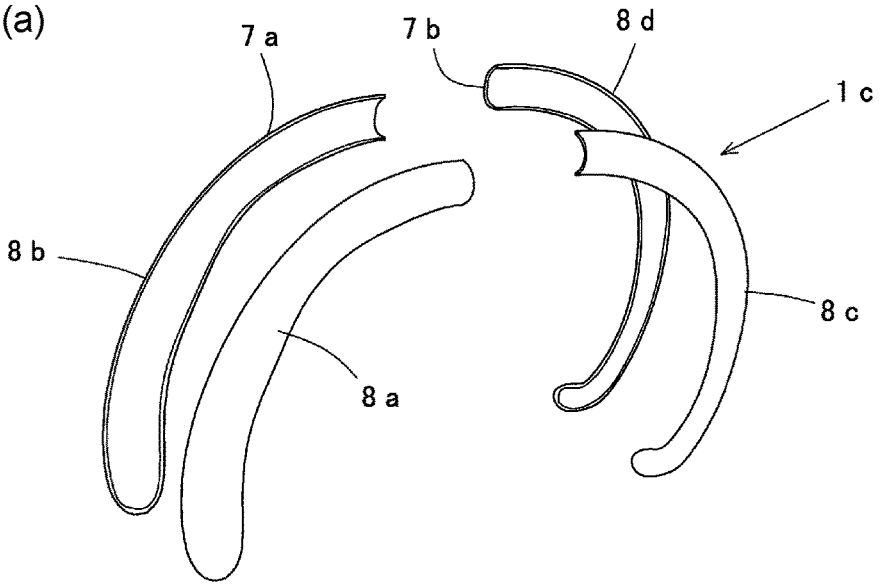
FIG. 6(*a*) is an exploded perspective view showing parts for making a substantially C-shaped part, and FIG. 6(*b*) is an exploded perspective view showing parts for making a substantially S-shaped part.
Figure 6B:
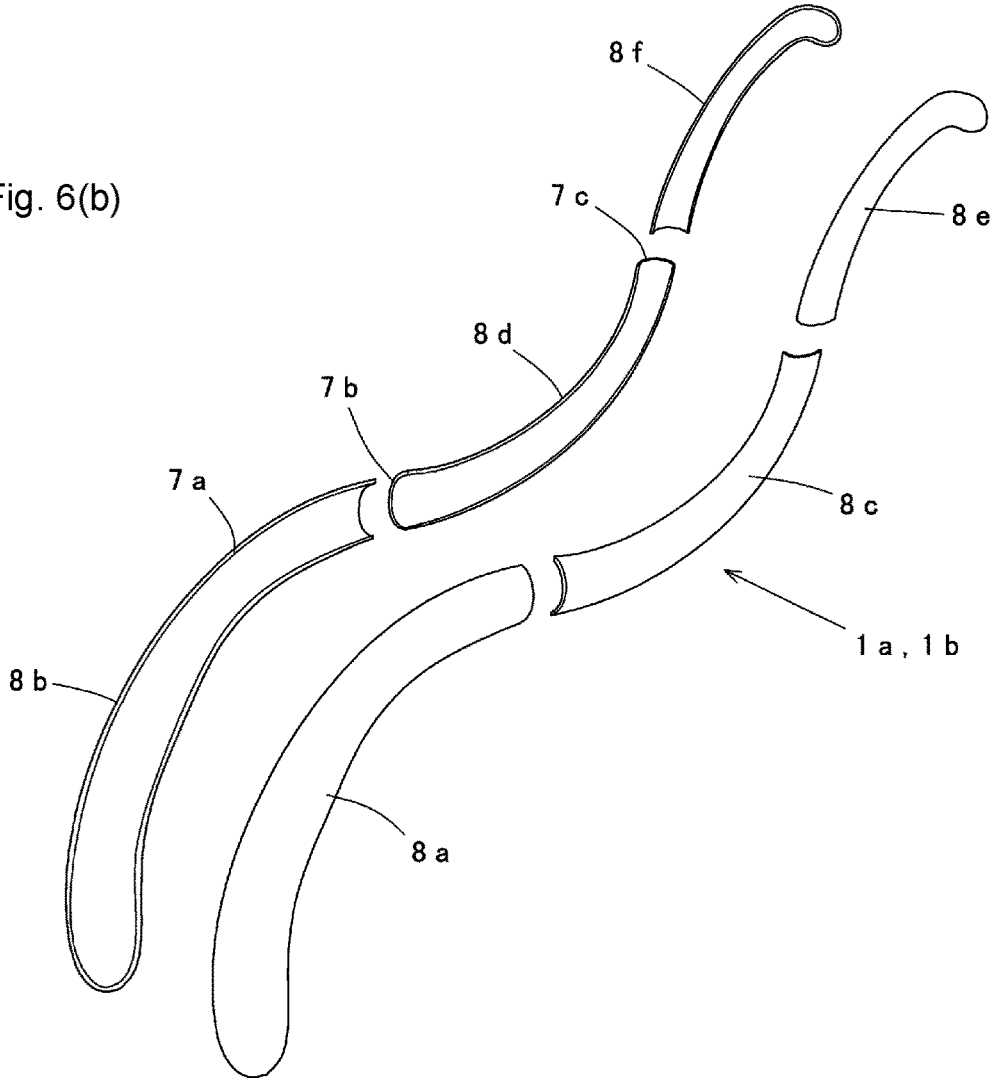

The substantially C-shaped part 1*c* is formed by casting four parts 8*a*, 8*b*, 8*c*, and 8*d* as shown in FIG. 6(*a*). The substantially C-shaped part 1*c* is divided in half thickness along the longitudinal direction by a dividing surface 7*a*, and divided again across the longitudinal direction by a surface 7*b*. These four parts are welded together to produce the substantially C-shaped part 1*c*. Although not shown in the figure, each part 8*a*, 8*b*, 8*c*, and 8*d* has holes 6 formed when casting.

The substantially S-shaped parts is formed by casting six parts 8*a*, 8*b*, 8*c*, 8*d*, 8*e*, and 8*f* as shown in FIG. 6(*b*). The left and right parts 8*c* and 8*d* on the tip side of the four parts 8*a*, 8*b*, 8*c*, and 8*d* are divided again by a dividing surface 7*c* at the middle part, and the parts 8*a*, 8*b*, 8*c*, 8*d*, 8*e*, and 8*f* are joined together so that the bending direction is reversed at the longitudinal dividing surfaces 7*b* and 7*c*. With this method, either the substantially C-shaped part 1*c* or the substantially S-shaped parts 1*a* and 1*b* can be easily produced from the same parts.

Figure 3A:
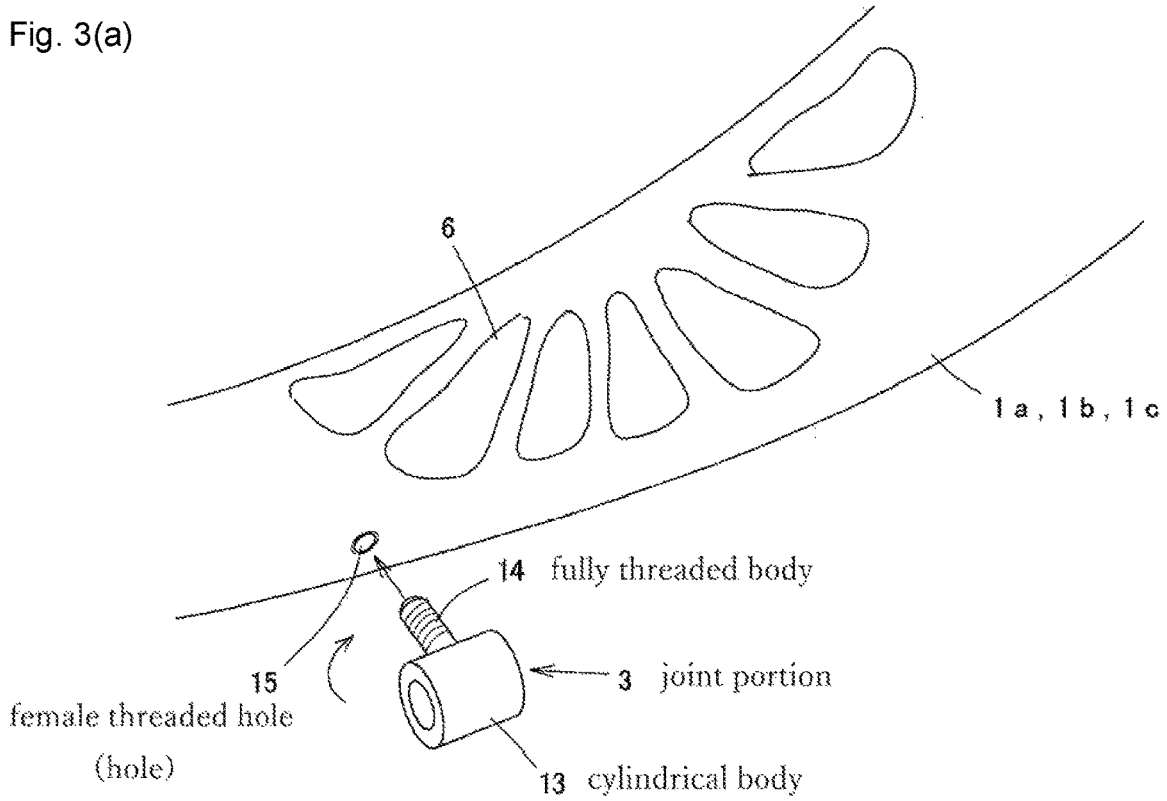
FIG. 3(*a*) is a perspective view showing the joint separated from the parts, and FIG. 3(*b*) is a perspective view showing the joint attached to the part.
Figure 3B:
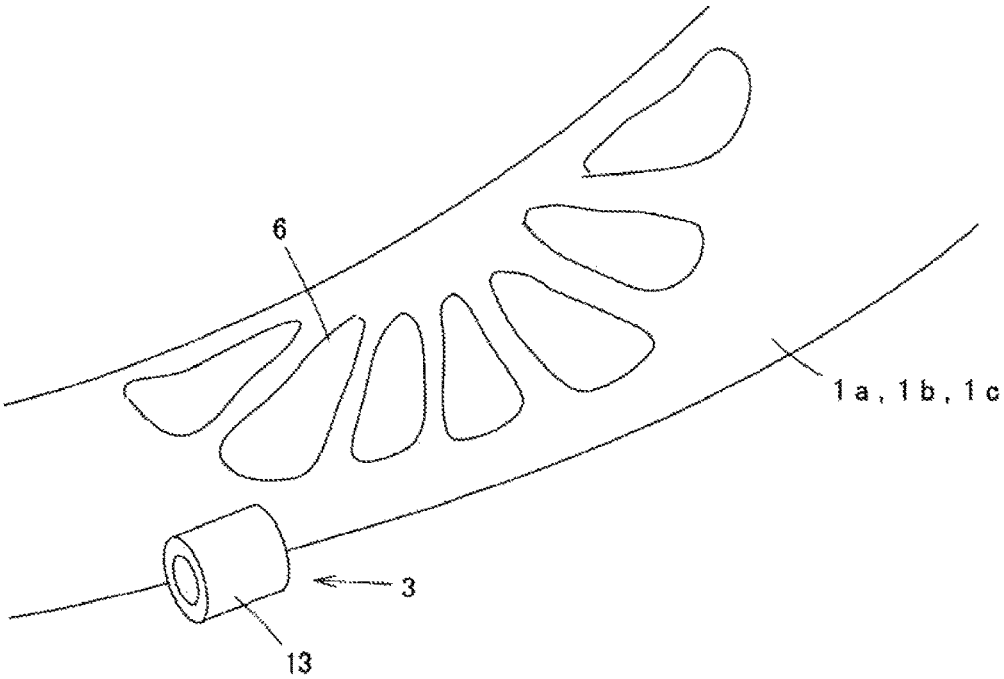

Each part 1*a*, 1*b*, and 1*c* has multiple joining portions 3, 3, . . . provided at appropriate locations on its surface. Each joining portion 3, 3, . . . has a metal cylinder 13 cut to a length of about 1-2 cm as shown in FIG. 3(*a*), and a fully threaded bolt 14 attached to the outer peripheral surface of the cylinder 13 by welding. The fully threaded bolt 14 is screwed into a female threaded hole 15 formed in parts 1*a*, 1*b*, and 1*c*, and as shown in FIG. 3(*b*), the outer peripheral surface of the cylinder 13 is attached to the surface of parts 1*a*, 1*b*, and 1*c* by being in contact with or close to them.

Figure 4A:
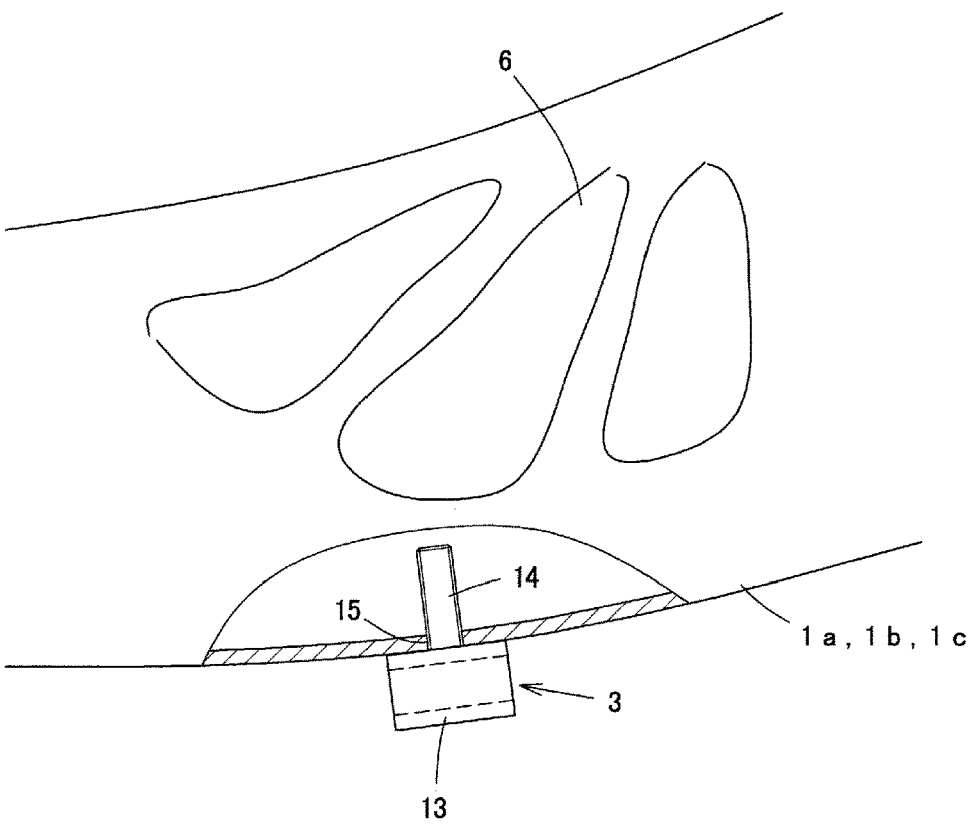
FIGS. 4(*a*) and 4(*b*) are cross-sectional views showing an example of the joint attached to a part.
Figure 4B:
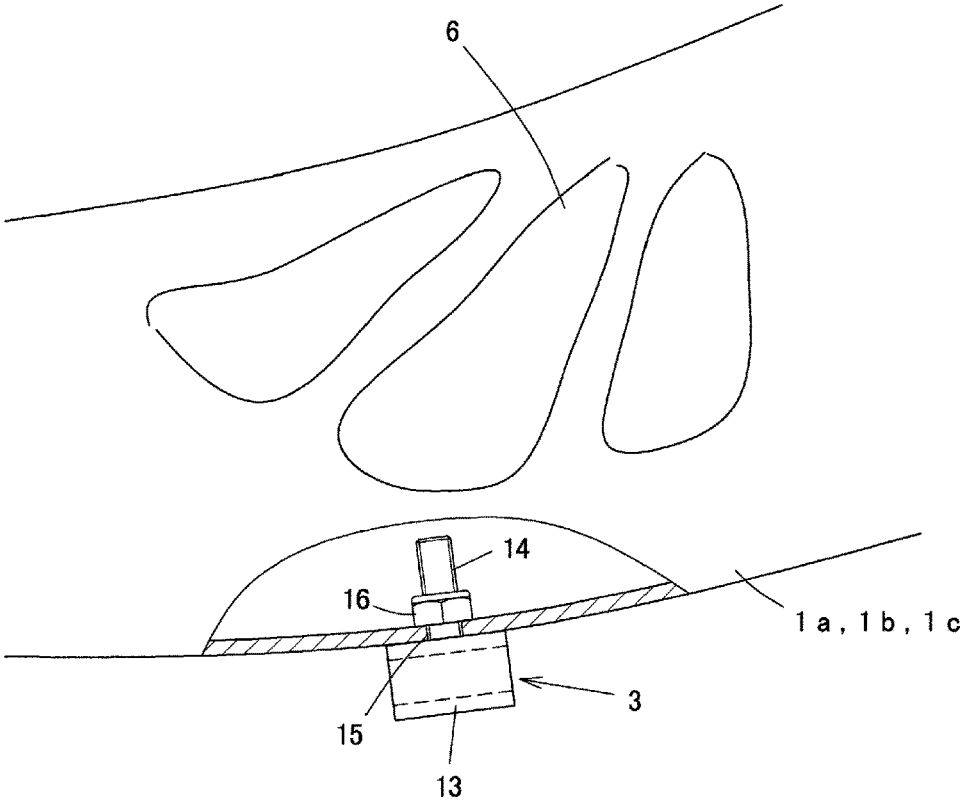
Figure 5:
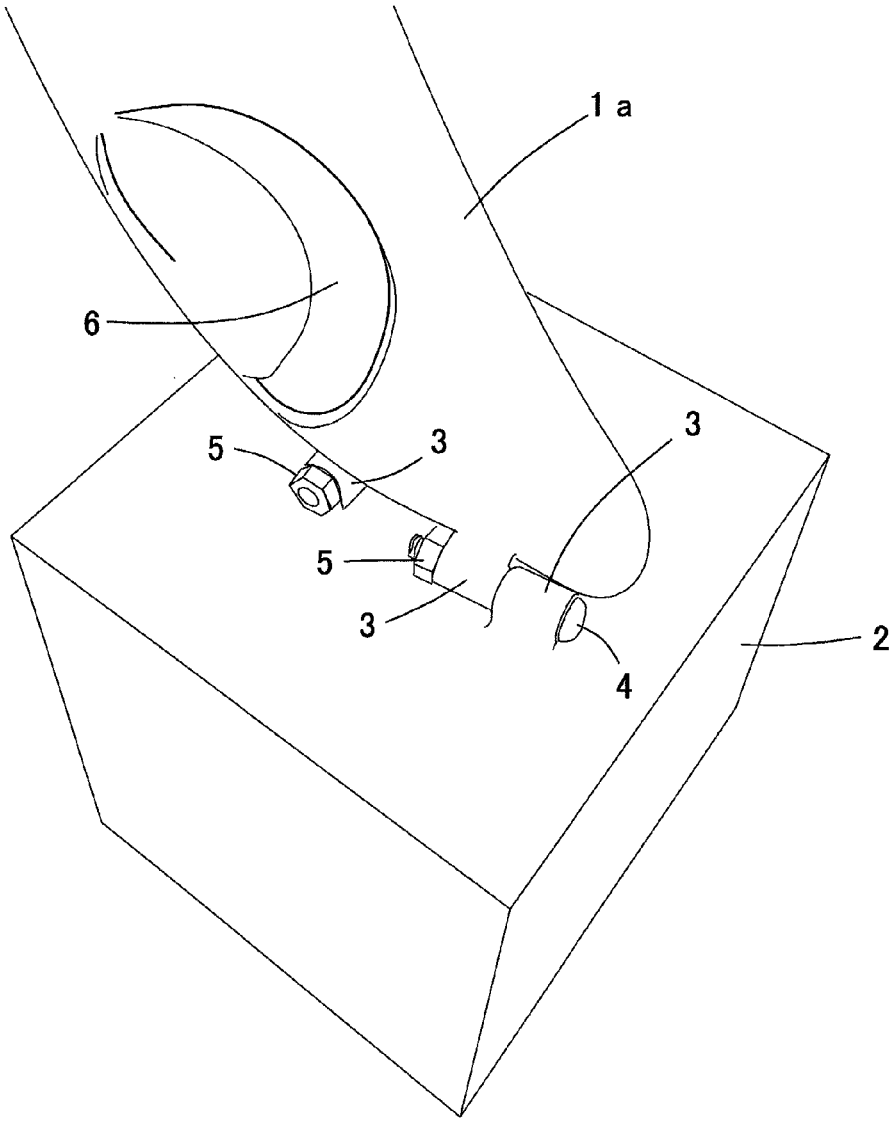
FIG. 5 is an enlarged perspective view showing the joint between a part and a base of the artwork.

The joint portion 3 may be attached to the parts 1*a*, 1*b*, and 1*c* simply by screwing the fully threaded bolt 14 into the female threaded hole 15, as shown in FIG. 4(*a*). Alternatively, a nut 16 may be inserted into a hole 6 formed in each part 1*a*, 1*b*, or 1*c*, and the nut 16 may be tightened by engaging it with the fully threaded bolt 14, as shown in FIG. 4(*b*). This allows the joint portion 3 to be securely fixed to the parts 1*a*, 1*b*, and 1*c* and enables adjustment of the axial direction of the cylinder 13.

Figure 2:
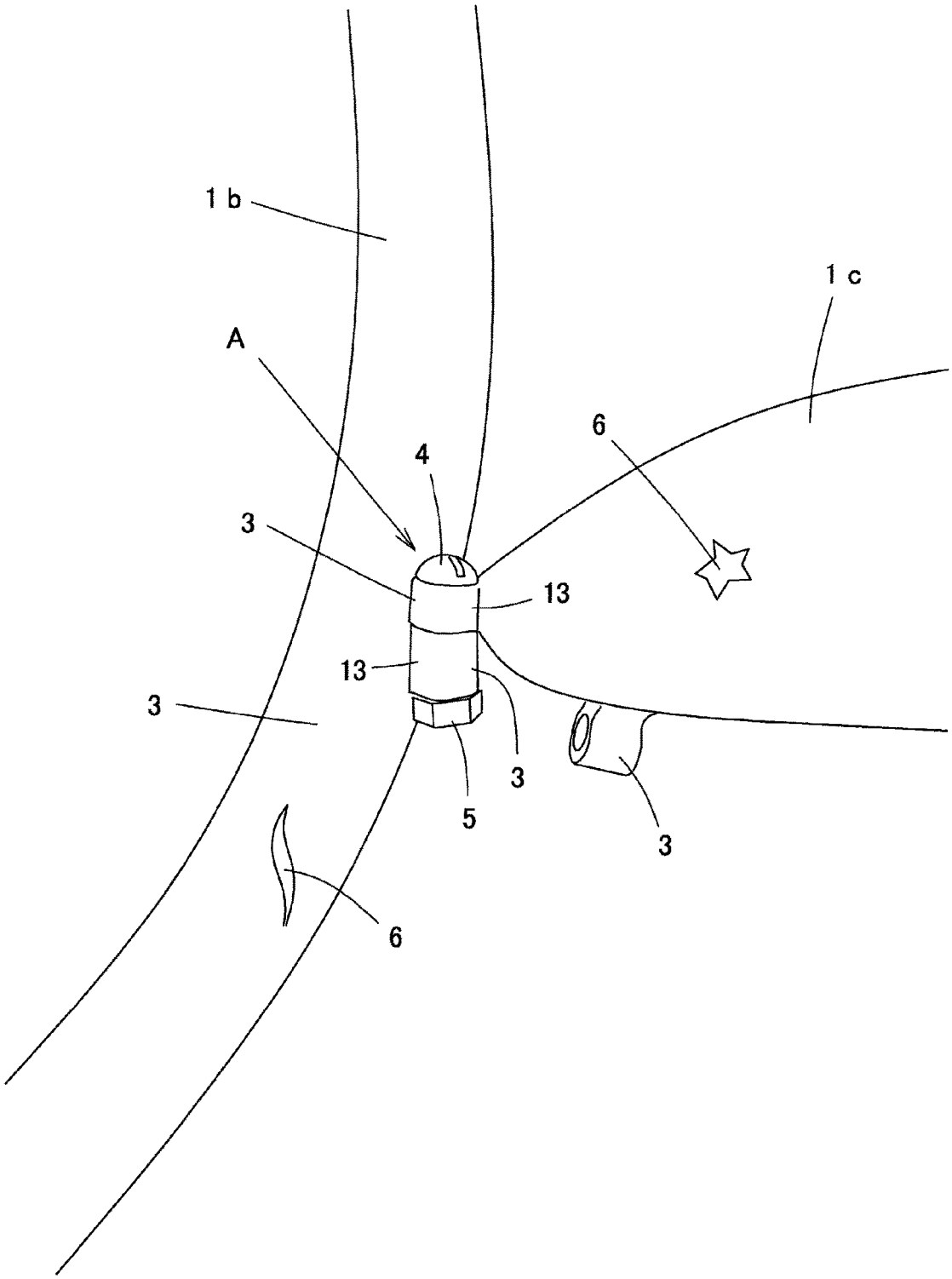
FIG. 2 is an enlarged perspective view showing the joint between parts of the artwork.

The parts 1*a*, 1*b*, and 1*c* are joined together by aligning their joint portions 3, 3 with each other on the end faces of the cylindrical body 13 as shown in FIG. 2, and passing the bolt (axis) 4 through them. Then, by tightening the nut 5 onto the threaded portion of the bolt 4 protruding from the joint portion 3, the parts 1*a*, 1*b*, and 1*c* are joined together. Therefore, by removing the bolt 4 and nut 5, each part 1*a*, 1*b*, and 1*c* can be separated and reassembled easily. Each part 1*a*, 1*b*, and 1*c* has extra joint portions 3, as shown in FIG. 2, for different assembly configurations.

The substantially S-shaped part 1*b* located in the upper left part of FIG. 1 is joined with other parts 1*a* and 1*c* at two joint locations A and B. The center axes of the bolts 4 at both joint locations A and B are aligned on the same straight line, so by loosening the bolts 4 or nuts 5 at both joint locations A and B, the same part 1*b* can be rotated around joint locations A and B as fulcrums, as indicated by arrow 9 in the figure.

Part 1*a* and the base 2 are also joined together by inserting bolts 4 through the joint portions 3, 3 provided on each of them, and tightening them with nuts 5 screwed onto the protruding bolt 4 from the joint portions 3. By removing the bolts 4 and nuts 5, part 1*a* and base 2 can be separated, as shown in FIG. 3.

Figure 7:
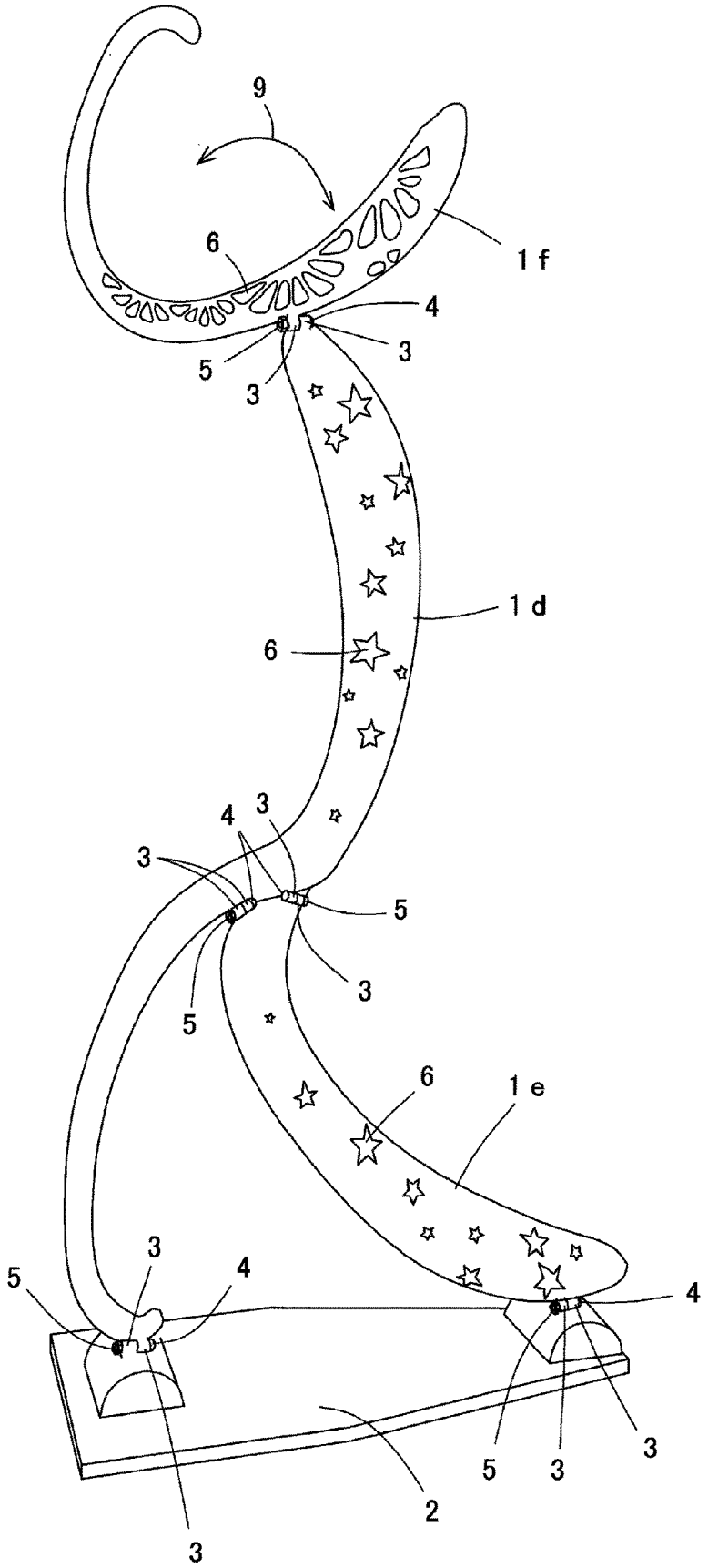
FIG. 7 is a perspective view showing another embodiment of the artwork according to the present invention.

FIG. 7 shows another embodiment of the artwork according to the present invention. This artwork consists of one roughly S-shaped part 1*d* made of cast metal, and two roughly C-shaped parts 1*e* and 1*f*, which are combined together. Additionally, it has a metal base 2 for displaying the artwork in an upright position. The parts 1*d*, 1*e*, 1*f* and the base 2 are joined and detachable from each other by passing bolts 4 through their respective connecting parts 3, 3, and tightening nuts 5, as in the embodiment described earlier. The upper C-shaped part 1*f* can be pivoted around the joint with part 1*d*, as indicated by arrow 9 in the figure.

Figure 8:
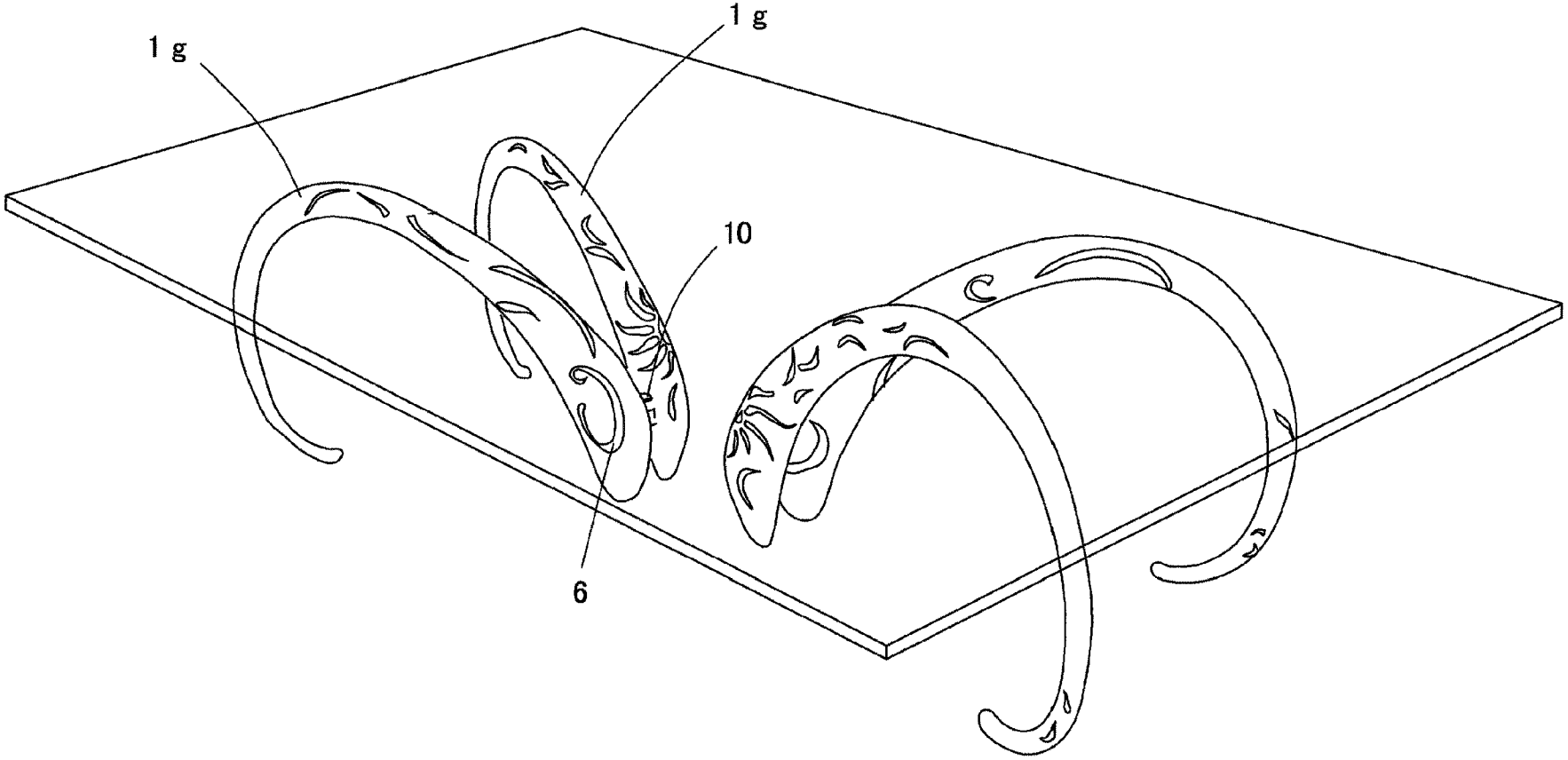
FIG. 8 is a perspective view showing yet another embodiment of the artwork according to the present invention.
Figure 9:
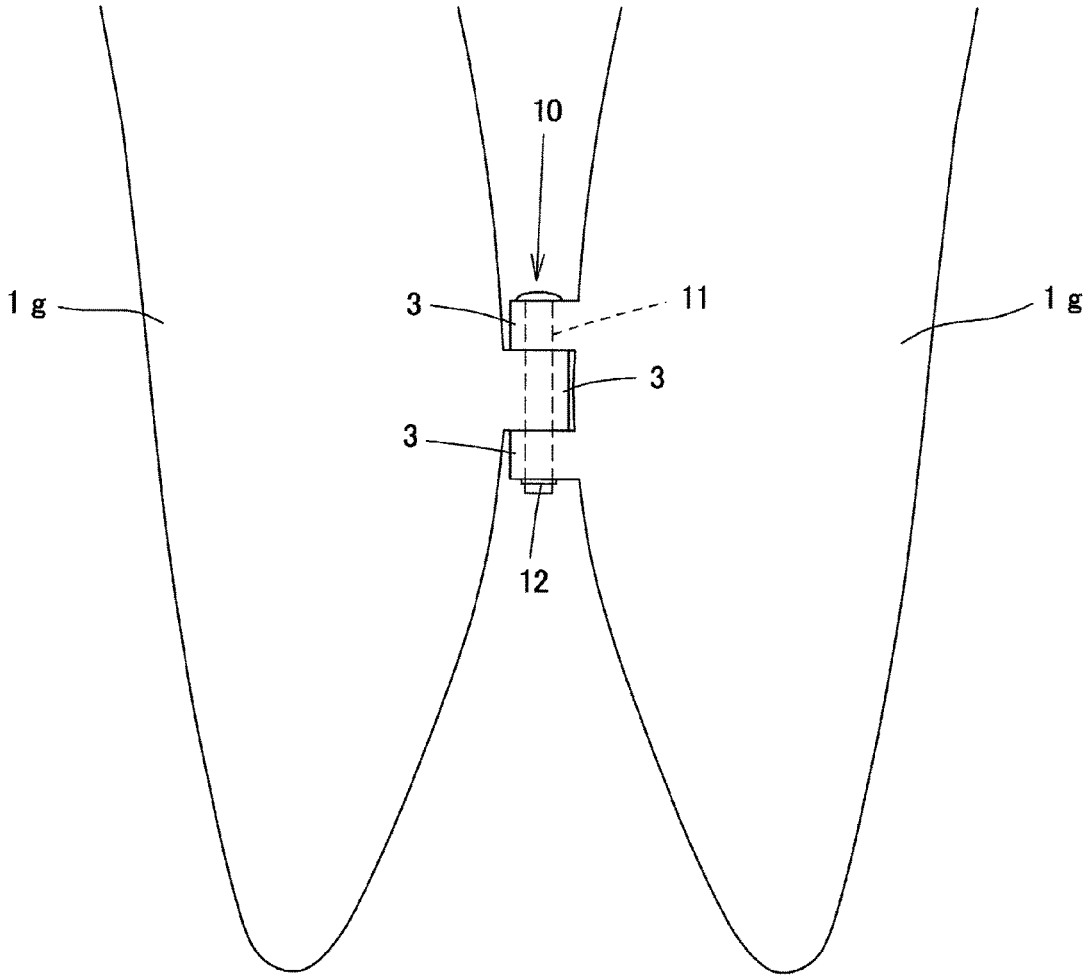
FIG. 9 is a front view showing an enlarged joint between parts of the artwork.

FIG. 8 shows another embodiment of the artwork according to the present invention, which can be used as a table leg. This artwork is constructed by connecting a pair of substantially C-shaped parts 1*g*, 1*g* formed in a hollow shape by a hinge 10. As shown in FIG. 9, the hinge 10 has cylindrical joint portions 3, 3, 3 attached to each part 1*g*, 1*g*, and a pin (axis) 11 is inserted from above into the joint portions 3, 3, 3, and a retaining ring 12 is attached to the tip of the pin 11 to prevent it from coming out. Instead of using the pin 11 and retaining ring 12, a bolt 4 and nut 5 can also be used.

Figure 10:
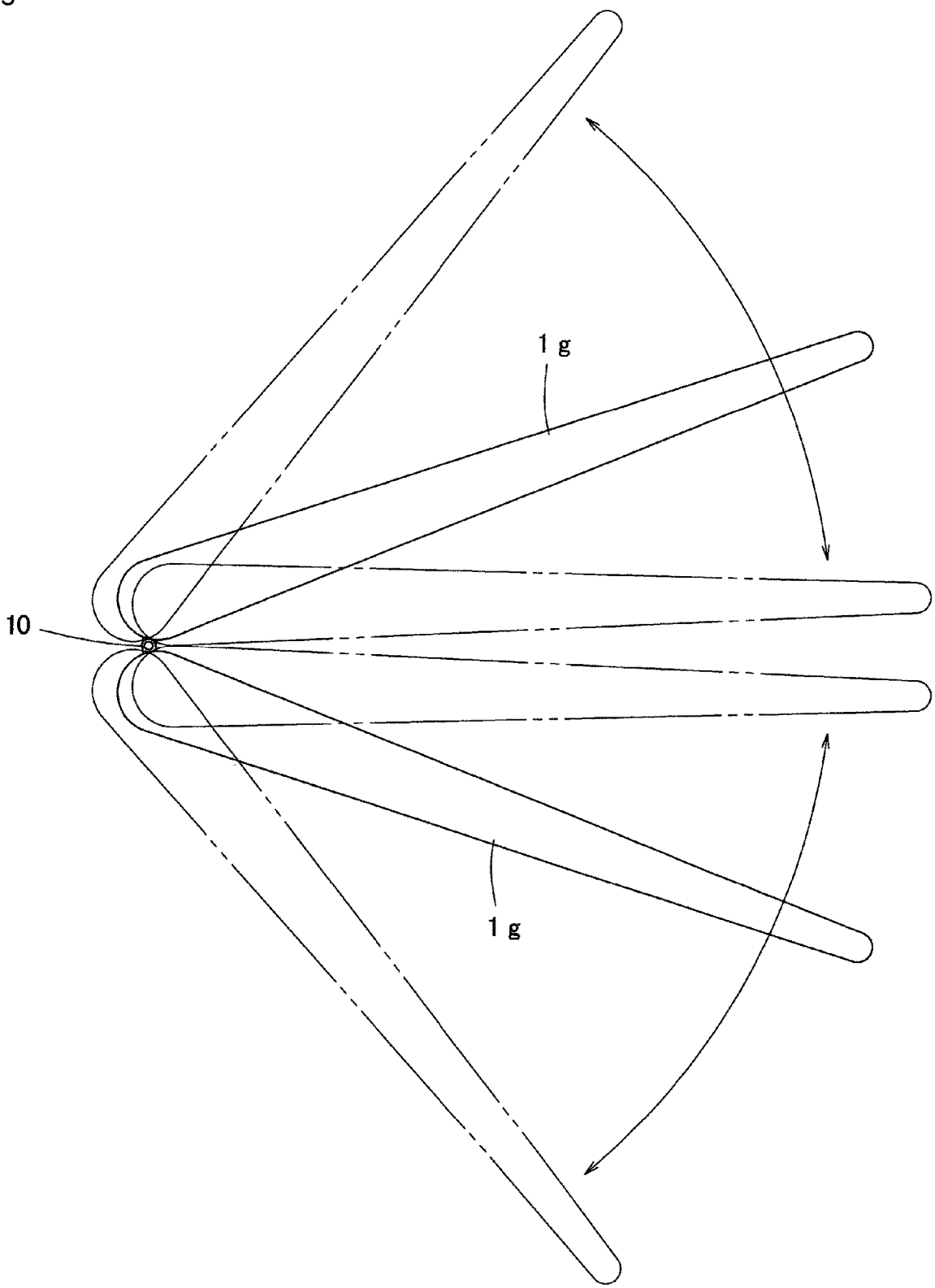
FIG. 10 is a plan view showing the open and closed state of the artwork.

This artwork can be separated into individual parts 1*g*, 1*g* by removing the retaining ring 12 and taking out the pin 11. As shown in FIG. 10, the angle between the two parts 1*g*, 1*g* can be adjusted from 0° to about 90° using the hinge 10 as a pivot, so when not in use, the two parts 1*g*, 1*g* can be almost stuck together and stored in a narrow space without separating them.

Figure 11:
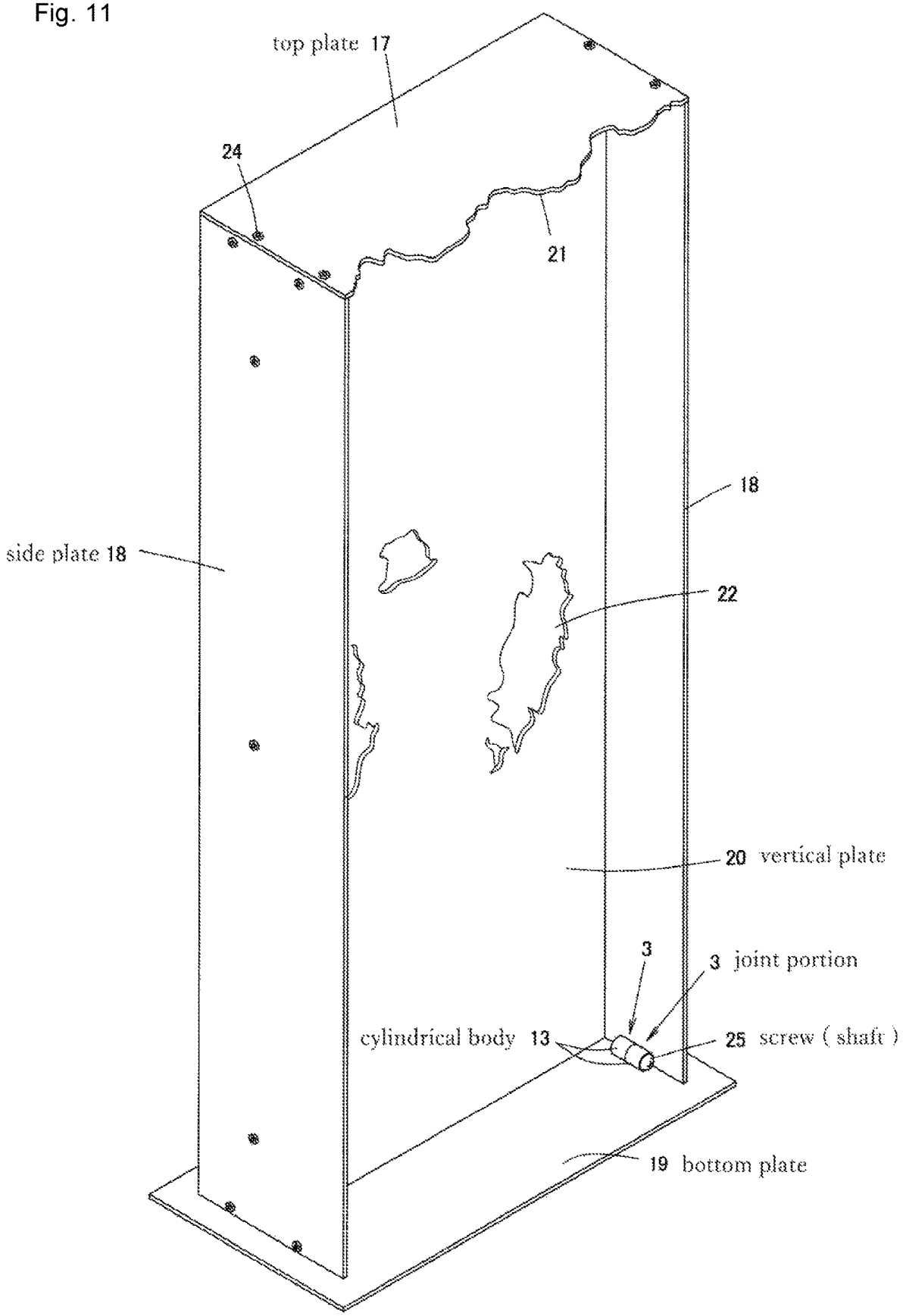
FIG. 11 is a perspective view showing another embodiment of the artwork according to the present invention.

FIG. 11 shows another embodiment of the artwork according to the present invention. This artwork is formed into a rectangular box shape by framing a bronze top plate (part) 17, left and right side plates (parts) 18, 18, and a bottom plate (part) 19, and attaching a vertical plate (part) 20 to the inside. The top plate 17 and the vertical plate 20 have intricate notches 21 and holes 22, which enhance the artistic appearance.

Figure 12A:
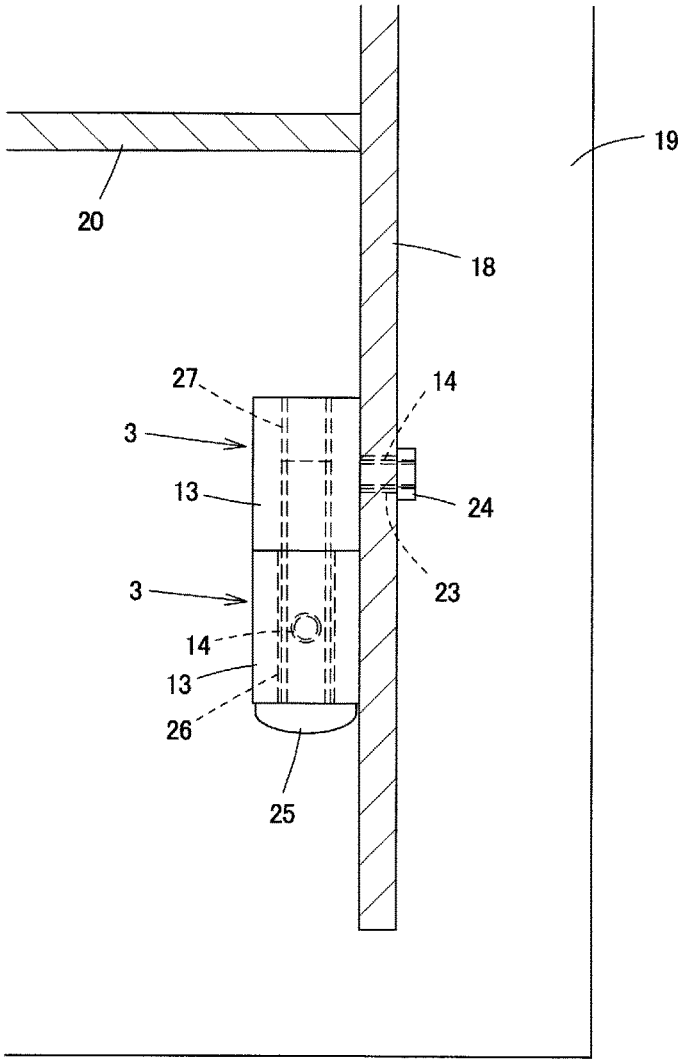
FIG. 12(*a*) is a cross-sectional view showing an enlarged joint between parts of the artwork, and FIG. 12(*b*) is a front view of the same.
Figure 12B:
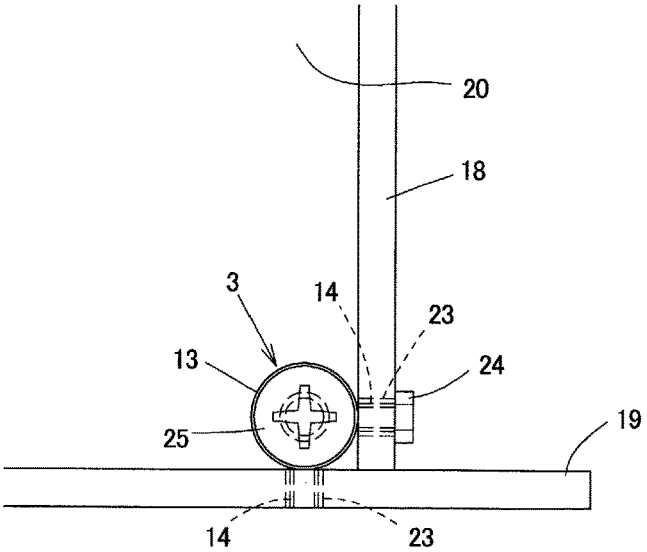

Parts 17, 18, 19, and 20 each have joint portions 3, as shown in FIG. 12. The joint portion 3 consists of a metal cylinder 13 cut to a length of about 1-2 cm and a fully threaded bolt 14 attached to the outer peripheral surface of the cylinder 13 by welding. The cylinder 13 is attached to each part 17, 18, 19, and 20 by inserting the fully threaded bolt 14 into a hole (dummy hole) 23 formed in each part 17, 18, 19, and 20 and tightening it with a nut 24 or by welding it. The two parts with joint portions 3 attached are connected and fixed by aligning the end faces of the cylinder 13 and passing a screw (axle) 25 through them. A dummy hole 26 for inserting the screw 25 is formed in the front-side cylinder 13, and a female screw hole 27 for screwing the screw 25 is formed in the rear-side cylinder 13, allowing the cylinders 13 to be connected and fixed to each other by simply tightening the screw 25 through the adjacent cylinders 13, 13. The parts can also be easily separated from each other by rotating the screw 25 in the reverse direction and pulling it out from the cylinders 13, 13.

As mentioned above, this artwork is capable of expressing a variety of abstract concepts by combining multiple parts of various shapes, such as 1*a*, 1*b*, 1*c*, 1*d*, 1*e*, 1*f*, 1*g*, 17, 18, 19, and 20. All things in nature are composed of combinations of curves, and by combining suitable parts of a roughly C-shaped or S-shaped design, it is possible to create outstanding works of art that strongly appeal to people's hearts. By preparing several types of parts of different sizes and shapes, such as 1*a*, 1*b*, 1*c*, 1*d*, 1*e*, 1*f*, and 1*g*, and freely combining them, it is possible to create an infinite number of expressions, and this standardized combination of parts enables the production of a wide range of unique and high-quality products in small quantities.

In addition, this artwork can be disassembled and assembled easily, allowing the parts 1*a*, 1*b*, 1*c*, 1*d*, 1*e*, 1*f*, 1*g*, 17, 18, 19, 20 to be separated and compactly packed for transportation, thus reducing transportation costs.

Furthermore, this artwork includes a metal base 2, which allows it to be easily displayed anywhere. Additionally, the parts 1*a*, 1*b*, 1*c*, 1*d*, 1*e*, and 1*f*, which are in the shape of abbreviated C or S, can be attached and detached from the base 2, making it easy to transport.

The art craft includes parts 1*a*, 1*b*, 1*c*, 1*d*, 1*e*, 1*f*, 1*g*, 17, 18, 19, 20, each having joint portions 3, 3, . . . respectively. By passing bolts 4 or screws 25 or pins 11 through the joint portions 3, 3, the parts 1*a*, 1*b*, 1*c*, 1*d*, 1*e*, 1*f*, 1*g*, 17, 18, 19, 20 can be joined and separated, and disassembly and assembly can be easily performed by anyone in a short time. When nuts 5 are screwed onto bolts 4 passing through joint portion 3, parts 1*a*, 1*b*, 1*c*, 1*d*, 1*e*, and if can be firmly fixed to each other by tightening bolts 4 or nuts 5. Moreover, since the joints 3 and the heads of bolts 4 or nuts 5 can be made inconspicuous, the appearance is not impaired.

When attaching the joint portion 3 to the surface of the parts 1*a*, 1*b*, 1*c*, 1*d*, 1*e*, 1*f*, 1*g*, 17, 18, 19, and 20 by welding, it is necessary to weld the joint portion 3 before performing the plating process on each part 1*a*, 1*b*, 1*c*, 1*d*, 1*e*, 1*f*, 1*g*, 17, 18, 19, and 20. If you want to change the combination of parts 1*a*, 1*b*, 1*c*, 1*d*, 1*e*, 1*f*, 1*g*, 17, 18, 19, and 20 later, you will have to sand or remove the joint parts 3 and perform plating process again, which is a cumbersome task.

In contrast, this artwork consists of a metal cylinder 13 that has been cut to a predetermined length as the joint portion 3 and a fully threaded bolt 14 attached to the outer surface of the cylinder 13. The fully threaded bolt 14 is fixed to holes (female screw holes 15, hole 23) formed in each part 1*a*, 1*b*, 1*c*, 1*d*, 1*e*, 1*f*, 1*g*, 17, 18, 19, and 20, and the outer surface 13 of the cylinder 13 is attached or brought into proximity to each part 1*a*, 1*b*, 1*c*, 1*d*, 1*e*, 1*f*, 1*g*, 17, 18, 19, and 20. Therefore, after applying a plating process to each part 1*a*, 1*b*, 1*c*, 1*d*, 1*e*, 1*f*, 1*g*, 17, 18, 19, and 20, joint portion 3 can be attached by simply machining holes 15 and 23 at any position, increasing the freedom of production. Furthermore, since the joint portion 3 can be easily removed, reusing unwanted parts 1*a*, 1*b*, 1*c*, 1*d*, 1*e*, 1*f*, 1*g*, 17, 18, 19, and 20 is also easy.

By inserting a nut 16 into the holes 6 formed in parts 1*a*, 1*b*, 1*c*, 1*d*, 1*e*, 1*f*, and 1*g*, and tightening it by screwing it onto the fully threaded bolt 14, the joint portion 3 can be firmly fixed to parts 1*a*, 1*b*, 1*c*, 1*d*, 1*e*, 1*f*, and 1*g* while also adjusting the axial direction of the cylinder 13.

Furthermore, this artwork allows for a variety of expressions by enabling the parts 1*b*, 1*f*, and 1*g*, which are shaped roughly C-shaped or S-shaped, to change their direction at the joint points with other parts. By changing the orientation of parts 1*b*, 1*f*, and 1*g* as desired, a wide range of expressions can be achieved, keeping the viewer engaged. Additionally, changing the orientation of parts 1*b*, 1*f*, and 1*g* can also save space during transportation.

This invention is not limited to the embodiments described above. The size, shape, material, number, etc. of the parts that make up the artwork can be appropriately modified. For example, parts in the roughly C-shaped or S-shaped can also be formed from resin. The structure of the connecting parts between the parts and between the parts and the base only needs to be a structure that can be repeatedly joined and separated and is not limited to the use of bolts and nuts. The method for producing parts in the shape of a C or S is optional, and it is not necessary to weld together halves of thickness along the longitudinal direction, but they can also be cast in a hollow shape.

REFERENCE SIGNS LIST

1*a*, 1*b*, 1*c*, 1*d*, 1*e*, 1*f*, 1*g*: parts
2: base
3: joint portion
4: bold
5: nut
11: pin
13: cylindrical body
14: fully threaded bolt
15: female threaded hole
17: top plate
18: side plate
19: bottom plate
20: vertical plate
23: hole
25: screw

The invention claimed is:

1. An artwork, comprising:

parts having various shapes, wherein each of the parts is provided with joint portions, and each of the joint portions have a cylindrical body with a prescribed length and a fully threaded bolt attached to an outer peripheral surface of the cylindrical body is positioned in a direction perpendicular to a central axis of the cylindrical body, wherein the fully threaded bolt is inserted into a hole formed in a corresponding one of the parts and a nut is screwed onto the fully threaded bolt protruding from the hole such that the outer peripheral surface of the cylindrical body is fixed in contact with or close to the corresponding one of the parts, wherein an end surface of the cylindrical body provided to one of the parts and an end surface of the cylindrical body provided to another of the parts contact each other, and wherein another bolt extends through the cylindrical body provided to one of the parts and the cylindrical body provided to another of the parts and a nut is screwed onto the another bolt to secure the cylindrical body provided to one of the parts and the cylindrical body provided to another of the parts to each other in a rotationally fixed manner.

2. A method for manufacturing the artwork of claim 1, the method comprising:

applying a surface treatment to the parts;

processing the hole into which the fully threaded bolt is inserted, formed in the corresponding one of the parts;

fixing the outer peripheral surface of the cylindrical body in contact with or close to the corresponding one of the parts by attaching the fully threaded bolt to the outer peripheral surface of the cylindrical body and inserting the fully threaded bolt into the hole formed in the corresponding one of the parts; and connecting the cylindrical body provided to one of the parts and the cylindrical body provided to another of the parts to each by contacting the end surface of the cylindrical body provided to one of the parts and the end surface of the cylindrical body provided to another of the parts with each other and screwing the nut onto the another bolt extending through the cylindrical body provided to one of the parts and the cylindrical body provided to another of the parts.

3. The artwork of claim 1, wherein the cylindrical body is directly attached to an outer peripheral surface of the corresponding one of the parts such that the fully threaded bolt is in the insertion direction of the hole into which the fully threaded bolt is inserted and is located in an interior portion of the corresponding one of the parts, and wherein the central axis of the cylindrical body is perpendicular to the insertion direction of the hole.

* * * * *